US006580882B2

(12) United States Patent
Hirsch et al.

(10) Patent No.: US 6,580,882 B2
(45) Date of Patent: Jun. 17, 2003

(54) LOW COST TRIM-GAP-CONDUCTIVITY TC SENSOR

(75) Inventors: Mark J. Hirsch, Fairport, NY (US); John F. Knapp, Fairport, NY (US); William H. Wayman, Ontario, NY (US); Thomas W. Pike, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/971,164

(22) Filed: Oct. 4, 2001

(65) Prior Publication Data

US 2003/0068166 A1 Apr. 10, 2003

(51) Int. Cl.[7] ..... G03G 15/08
(52) U.S. Cl. ..... 399/58; 399/61; 399/272
(58) Field of Search ..... 399/58, 61, 62, 399/27, 29, 30, 272

(56) References Cited

U.S. PATENT DOCUMENTS

| | | | | |
|---|---|---|---|---|
| 3,873,002 A | | 3/1975 | Davidson et al. | 222/56 |
| 3,932,034 A | * | 1/1976 | Takahashi | 399/61 |
| 4,318,610 A | | 3/1982 | Grace | 355/14 D |
| 4,326,646 A | | 4/1982 | Lavery et al. | 222/56 |
| 4,348,099 A | | 9/1982 | Fantozzi | 355/14 E |
| 4,538,897 A | * | 9/1985 | Osaka et al. | 399/29 |
| 4,956,669 A | | 9/1990 | Nakamura | 355/208 |
| 5,081,491 A | | 1/1992 | Lux et al. | 355/208 |
| 5,214,477 A | * | 5/1993 | Hirobe et al. | 399/27 |
| 5,574,539 A | | 11/1996 | Wong | 399/62 |

FOREIGN PATENT DOCUMENTS

| | | |
|---|---|---|
| JP | 2-214875 | * 8/1990 |
| JP | 4-157489 | * 5/1992 |
| JP | 4-282670 | * 10/1992 |

OTHER PUBLICATIONS

English Abstract for JP 59–71066A, Apr. 1984, Japan.

* cited by examiner

*Primary Examiner*—Joan Pendegrass
(74) *Attorney, Agent, or Firm*—Lloyd F. Bean, II

(57) ABSTRACT

A toner maintenance system for an electrophotographic developer unit, including a sump for storing a quantity of developer material comprised of carrier and toner material; a first member for transporting a mixture of developer material and toner particles from the sump, the first member having a voltage applied thereto; a metering blade, positioned closely adjacent to the first member to maintain the compressed pile height of the developer material on first member at a desired level; and a sensor device for measuring the current between the first member and the metering blade, and generating a signal indicative thereof.

12 Claims, 4 Drawing Sheets

LOW COST TRIM-GAP-CONDUCTIVITY TC SENSOR

This invention relates generally to a printing machine, and more particularly concerns an apparatus for controlling the concentration of toner in the development system of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In a machine of the foregoing type, it is desirable to regulate the addition of toner particles to the developer material in order to ultimately control the triboelectric characteristics (tribo) of the developer material. However, control of the triboelectric characteristics of the developer material are generally considered to be a function of the toner concentration within the material. Therefore, for practical purposes, machines of the foregoing type usually attempt to control the concentration of toner in the developer material.

Toner tribo is a very "critical parameter" for development and transfer. Constant tribo would be an ideal case. Unfortunately, it varies with time and environmental changes. Since tribo is almost inversely proportional to Toner Concentration (TC) in a two component developer system, the tribo variation can be compensated for by the control of the toner concentration.

Toner Concentration is conventionally measured by a Toner Concentration (TC) sensor. The problems with TC sensors are that they are expensive, not very accurate, and rely on an indirect measurement technique which has poor signal to noise ratio.

Various approaches have been devised for controlling the concentration of toner in the development system. The following disclosures appear to be relevant:

U.S. Pat. No. 3,873,002 granted to Davidson et al. describes a control device which regulates the dispensing of predetermined quantities of particles from a storage container to a mix for maintaining the concentration thereof substantially at a preselected level. Specifically, a detecting means is used to determine the toner concentration and to signal a count detector. Subsequently, control logic analyzes the value contained in the count detector to determine whether a half or full toner dispense cycle is required.

U.S. Pat. No. 4,318,610 granted to Grace describes an apparatus in which toner particle concentration within a developer mixture and charging of the photoconductive surface are controlled. More specifically, an infrared densitometer generates electrical signals proportional to the developed toner mass of test areas on the photoconductive surface. The signals are fed through a conversion circuit and subsequently interpreted by a controller. The controller energizes a toner dispense motor, via a logic interface, whenever the detected density of the toner concentration test patch is below a nominal level. In addition, successive energizing of the toner dispense motor without an increase in detected density results in the generation of a "toner container empty" signal by the controller.

U.S. Pat. No. 4,326,646 granted to Lavery et al. discloses an automatic development control system utilizing a control loop to vary the time period of activation of a toner dispenser. The toner dispenser is activated for a predetermined fraction of the copy cycle depending upon the relative density of a test patch versus a desired density. For example, when the detected test patch toner density is first indicated as low, the toner dispenser is activated for a period of 0.5 seconds. For successive indications of a low toner density the toner dispenser is activated in increments of 0.5 seconds up to a maximum period of 1.5 seconds.

U.S. Pat. No. 4,348,099 granted to Fantozzi teaches a sample data control system for controlling charge, illumination, toner dispensing, and developer bias. The system disclosed utilizes a toner dispensing control loop for regulating toner, wherein the control loop responds to a signal from an infrared sensor which detects the density of a developed test patch. Specifically, the voltage level from the sensor is compared against a reference voltage. If the voltage from the sensor is indicative of a toner density less than the desired density, the dispense motor is activated at a low or high rate. Once the toner density is determined to be sufficiently greater than the desired density, the dispense motor is turned off. This control process continues with the dispense motor being activated as required and the adjustment or activation of the toner dispenser being made if required preferably after each even copy cycle.

U.S. Pat. No. 4,956,669 granted to Nakamura describes a control apparatus for controlling the concentration of toner incorporated in developing material by means of controlling toner replenishment. Specifically, a toner concentration detecting sensor signal is analyzed to detect an abnormal sensor condition. When such a situation occurs, toner is dispensed at a constant volume. If the sensor is operating normally, an average signal level is used to determine the toner volume to be dispensed.

U.S. Pat. No. 5,081,491 granted to Lux et al. describes an apparatus for controlling the concentration of toner within a developer material of carrier and toner. The apparatus having a control means for generating a toner addition signal indicative of the amount of toner to be added to the developer material. The control means including the ability to measure the concentration of toner within the developer material during at least a first period and a second period subsequent to the first period. The control means also determining a first concentration error as a function of the deviation between the toner concentration measured during the first period and a reference toner concentration and a second concentration error as a function of the deviation between the toner concentration measured during the second period and the reference toner concentration. Subsequently, the control means generates the toner addition signal as a function of the first and second concentration error values. The apparatus also includes means, responsive to the toner addition signal, for regulating the addition of toner to said developer material.

In accordance with one aspect of the present invention, is that it employs a metering blade in conjunction with a current sensing device to measure the toner concentration in the developer material.

Pursuant to another aspect of the present invention, there is provided a toner maintenance system for an electrophotographic developer unit, including a sump for storing a quantity of developer material comprised of carrier and toner material; a first member for transporting a mixture of developer material and toner particles from said sump, said first member having a voltage applied thereto; a metering blade, positioned closely adjacent to said first member to maintain the compressed pile height of the developer material on first member at a desired level; and a sensor device for measuring the current between said first member and said metering blade, and generating a signal indicative thereof.

Pursuant to yet another aspect of the present invention, there is provided an electrophotographic printing machine having a toner maintenance device in which a toner image is developed on a photoreceptive member, having a toner maintenance device, comprising:

a sump for storing a quantity of developer material comprised of carrier and toner material;

a first member for transporting a mixture of developer material and toner particles from said sump, said first member having a voltage applied thereto; a metering blade, positioned closely adjacent to said first member to maintain the compressed pile height of the developer material on first member at a desired level; and a sensor device for measuring the current between said first member and said metering blade, and generating a signal indicative thereof.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
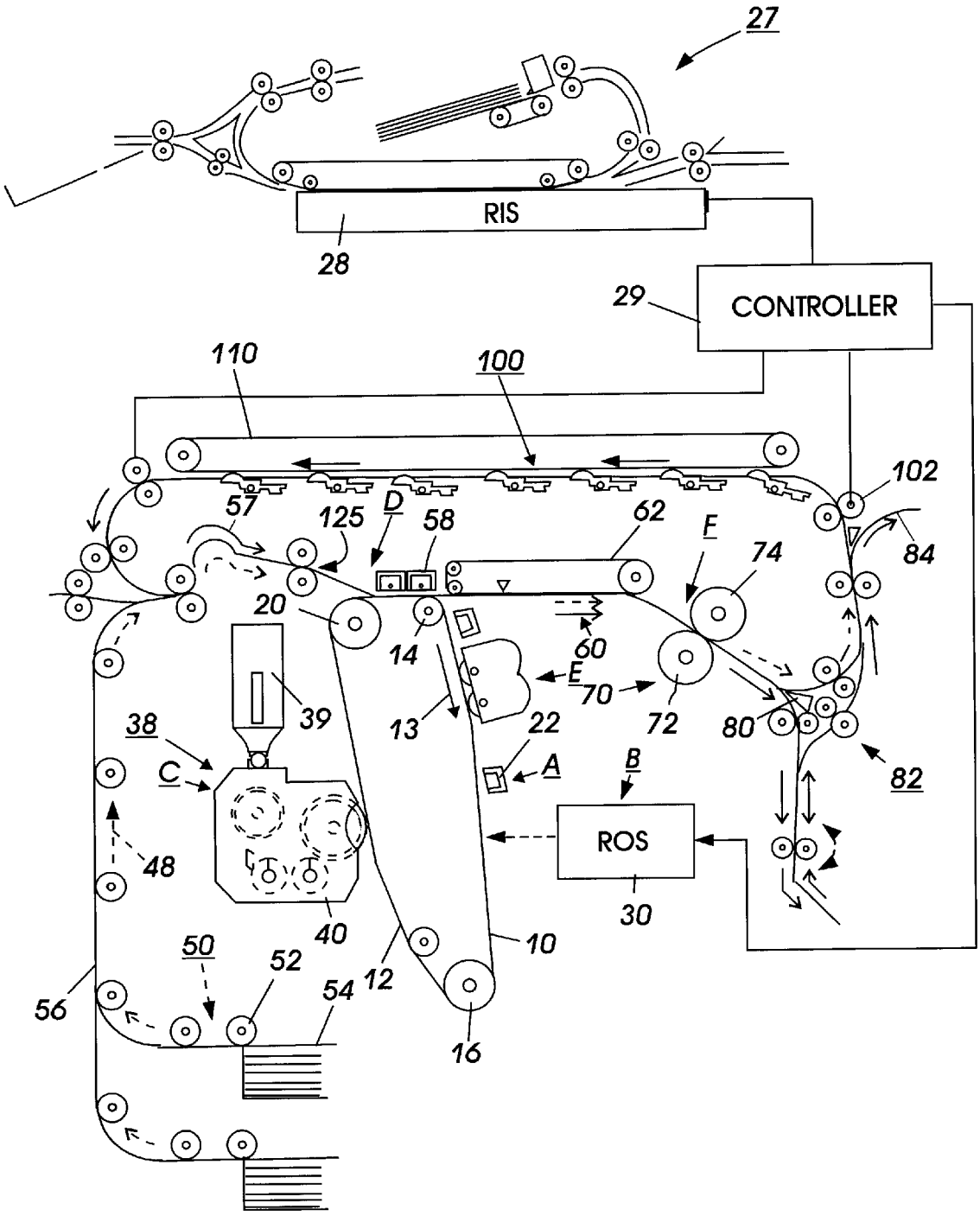
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the toner control apparatus of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS illuminates the charged portion of photoconductive belt 10 at a resolution of about 300 or more pixels per inch.

The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from the toner maintenance sensor as described below.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72.

The sheet then passes through fuser assembly 70 where the image is permanently fixed or fused to the sheet. After passing through fuser assembly 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to an output. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser assembly 70 for receiving and permanently fixing the side two image to the backside of that duplex sheet, before it exits via an exit path.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller 29 is preferably a programmable microprocessor which controls all of the machine functions herein before described including toner dispensing. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the features of the present invention therein.

Figure 2:
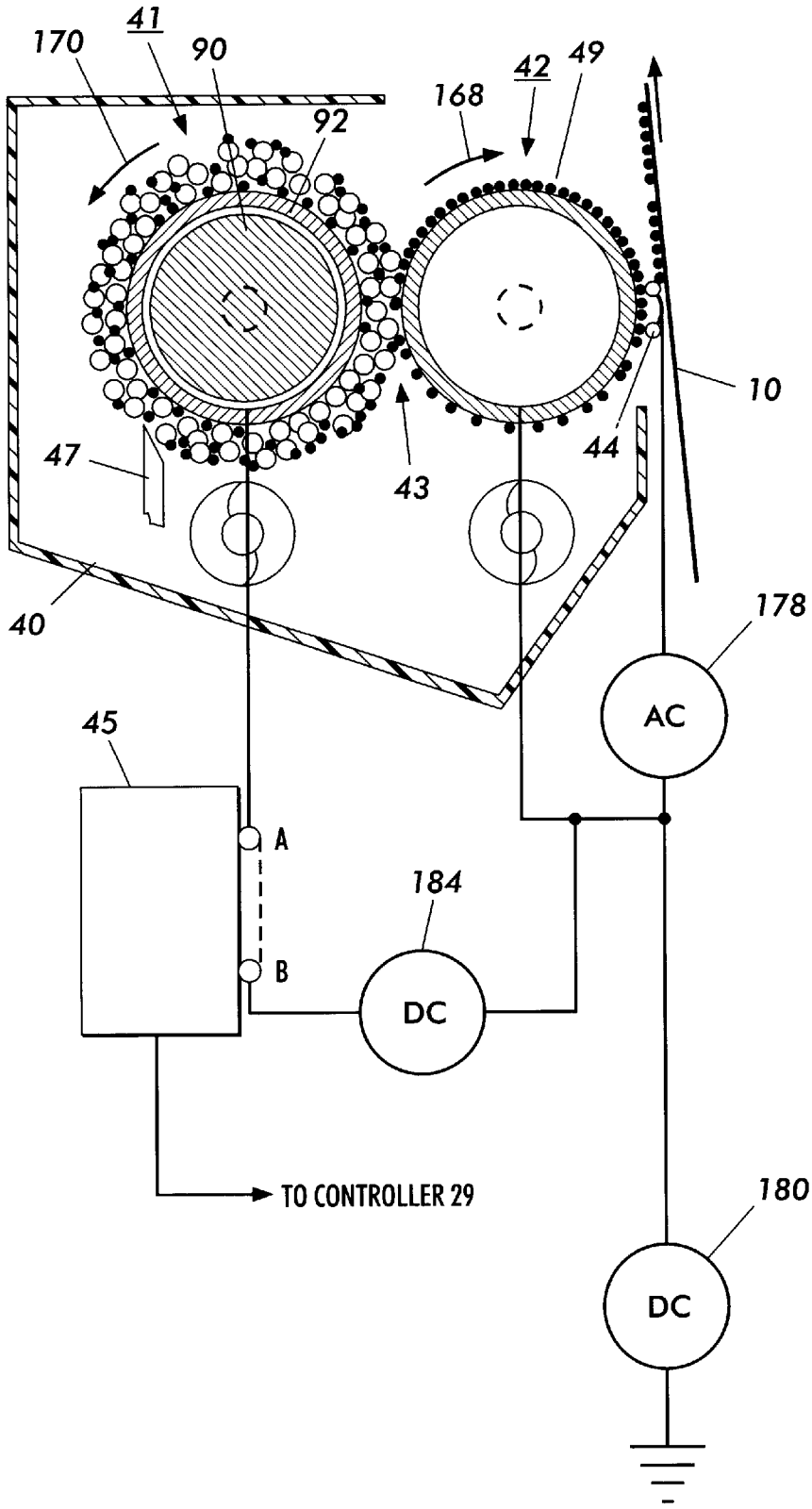
FIG. 2 is a schematic elevational view of the development system utilizing the invention herein.
Figure 3:
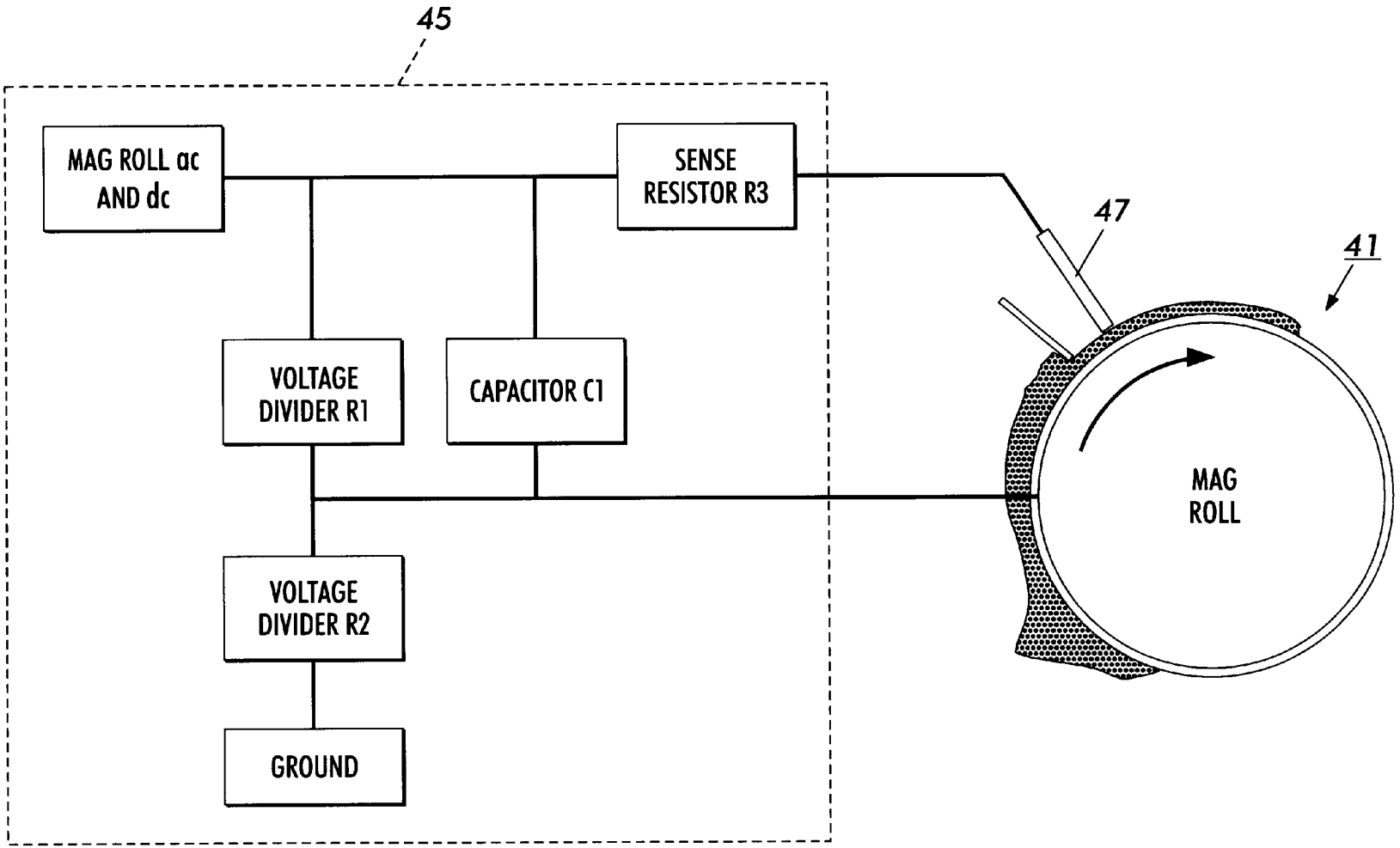
FIG. 3 is a schematic of one embodiment of a current sensing circuit for the invention herein.

Turning now to FIGS. 2 and 3, there is shown development system 38 in greater detail. [More specifically a hybrid development system is shown where toner is loaded onto a donor roll from a second roll (e.g. a magnetic brush roll). The toner is developed onto the photoreceptor from the donor roll using one of many techniques which include: wire scavengeless, embedded wire scavengeless, AC jumping, DC jumping, and contact.] As shown thereat, development system 38 includes a housing 40 defining a sump for storing a supply of developer material therein. Donor roller 42, electrode wires 44 and magnetic roller 41 are mounted in chamber of housing 40. The donor roller 42 can be rotated in either the 'with' or 'against' direction relative to the direction of motion of the photoreceptor.

In FIG. 2, donor roller 42 is shown rotating in the direction of arrow 168, i.e. the 'against' direction. Similarly, the magnetic roller 41 can be rotated in either the 'with' or 'against' direction relative to the direction of motion of donor roller 42. In FIG. 2, magnetic roller 41 is shown rotating in the direction of arrow 170 i.e. the 'with' direction. Development system 38 also has electrode wires 44 which are disposed in the space between the photoreceptor belt 10 and donor roller 42. A pair of electrode wires are shown extending in a direction substantially parallel to the longitudinal axis of the donor roller. The electrode wires are made from one or more thin (i.e. 50 to 100 $\mu$diameter) wires (e.g. made of stainless steel or tungsten) which are closely spaced from donor roller 42. The distance between the wires and the donor roller is approximately 25 $\mu$ or the thickness of the toner layer on the donor roll. The wires are self-spaced from the donor roller 42 by the thickness of the toner on the donor roller. To this end the extremities of the wires supported by the tops of end bearing blocks also support the donor roller for rotation. The ends of the wires are now precisely positioned between 10 and 30 microns above a tangent to the donor roll surface. With continued reference to FIG. 2, an alternating electrical bias is applied to the electrode wires by an AC voltage source 178. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is on the order of 200 to 500 volts peak at a frequency ranging from about 3 kHz to about 10 kHz. A DC bias supply 180 which applies approximately 300 volts to donor roller 42 establishes an electrostatic field between photoconductive surface of belt 10 and donor roller 42 for attracting the detached toner particles from the cloud surrounding the wires to the latent image recorded on the photoconductive surface. At a spacing ranging from about 10 $\mu$ to about 40 $\mu$ between the electrode wires and donor roller, an applied voltage of 200 to 500 volts produces a relatively large electrostatic field without risk of air breakdown. The use of a dielectric coating on either the electrode wires or donor roller helps to prevent shorting of the applied AC voltage.

Magnetic roller 41 meters a constant quantity of toner having a substantially constant charge onto donor roller 42. This insures that the donor roller provides a constant amount of toner having a substantially constant charge as maintained by the present invention in the development gap.

A DC bias supply 184 which applies approximately 100 volts to magnetic roller 41 establishes an electrostatic field between magnetic roller 41 and donor roller 42 so that an electrostatic field is established between the donor roller and the magnetic roller which causes toner particles to be attracted from the magnetic roller to the donor roller.

Metering blade 47 is positioned closely adjacent to magnetic roller 41 to maintain the compressed pile height of the developer material on magnetic roller 41 at the desired level. The spacing between the magnetic roller and metering blade is a fixed known spacing between 0.25 and 2 mm. Metering blade is made from conductive materials such as aluminum or stainless steel.

Magnetic roller 41 includes a non-magnetic tubular member 92 made preferably from aluminum and having the exterior circumferential surface thereof roughened. An elongated magnet 90 is positioned interiorly of and spaced from the tubular member. The magnet is mounted stationarily. The tubular member rotates in the direction of arrow 170 to advance the developer material adhering thereto into the nip 43 defined by donor roller 42 and magnetic roller 41. Toner particles are attracted from the carrier granules on the magnetic roller to the donor roller.

It is known that the electrical conductivity of developer depends on TC. For instance, see U.S. Pat. Nos. 5,812,903 and 5,574,539 for discussions on the functional dependence of conductivity on TC and on the static and dynamic modes of measuring conductivity. Applicants have found that the trim zone provides a natural place in a typical magnetic brush housing to measure the developer conductivity. The magnetic roll surface is conductive and the metering blade is typically made of metal to provide durability, thus providing the two electrodes required for the conductivity measurement. Moreover, the trim gap is already controlled to a tight tolerance in order to provide a specific uniform flow of developer to the nip. This uniform flow is also useful in decreasing the variability of the conductivity measurement.

To minimize cost of the sensor, it is important to use the power supply that normally powers the magnetic roll. FIG. 3 shows a schematic circuit 45 used in the present invention. Of course, other types of circuits are possible that would accomplish the same results. The magnetic roll normally has a bias with a fixed DC component between −300 and −500 volts and an AC component near 1000 Vpp and 3–10 kHz frequencies.

Applicants have found that polarity is important; toner needs to be repelled from the metering blade. In FIG. 3, R1 and R2 serve as a voltage divider that puts the metering blade and magnetic roll at different potentials. The polarity will be correct for Discharge Area Development (DAD). For Charge Area Development (CAD) one would reverse the leads going to the magnetic roll and metering blade. The combined resistance R1+R2 must be large enough to prevent loading of the power supply. Capacitor C1 is low impedance to the high frequency AC and insures that the same AC level goes to both the metering blade and magnetic roll. Thus, there is only a DC level across the trim gap. This is important to avoid possible developer breakdown and complications arising from the non-ohmic nature of the conductivity. Resistor R3 serves as a sense resistor. We have found that with 50 volts across the trip gap the currents are of the order of 0.1 to 0.8 microamps. These currents give voltages of 10 to 80 millivolts across a 100 kOhm resistor.

Figure 4:
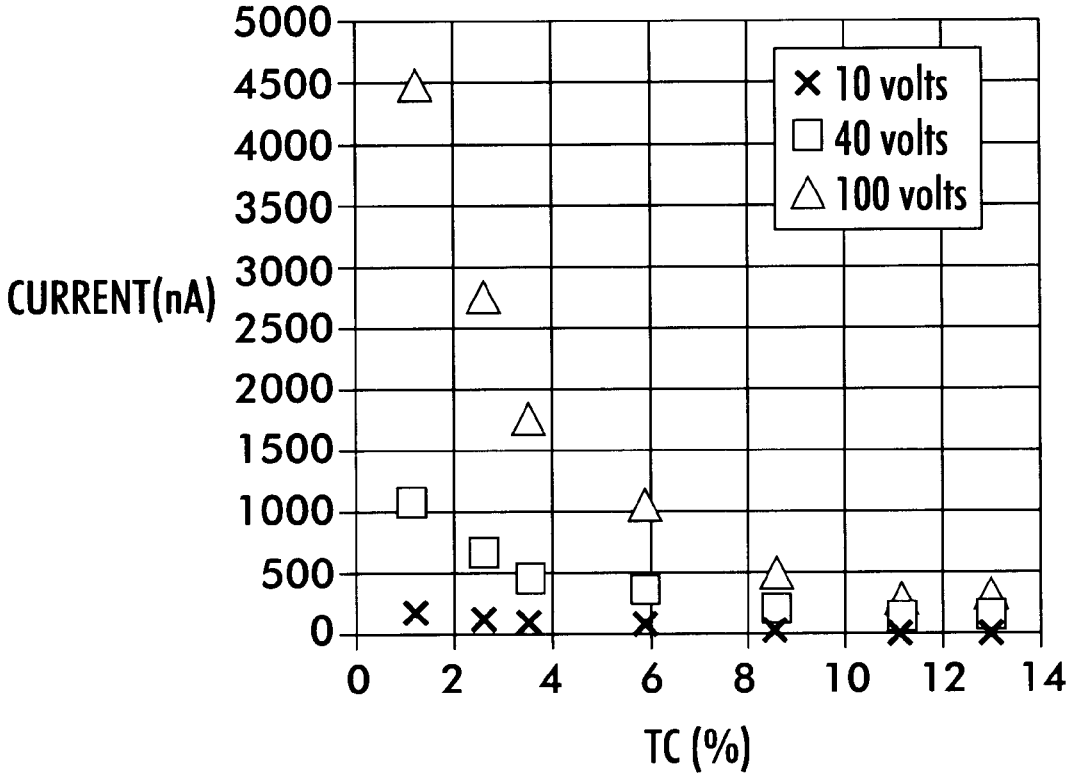
FIG. 4 is a graph illustrating the conductivity data which indicates that toner concentration as a function of current.

A typical sensor signal of current (voltage across the sense resistor) vs. TC is shown in FIG. 4. The current is non-linear in TC, being more sensitive in the lower TC regions. The current also depends on the voltage applied across the trip gap. Data for three different voltages, 10, 40, and 100 volts are shown in FIG. 4. The stability of the sensor signal against noise factors is always a concern for any type of sensor. We have tested the stability of the current in the circuit to material age, environmental zone, and trip gap setting.

In operation of the present invention the current between the magnetic roll and the metering blade is measured, and a signal is generated by controller 29 as a function thereof. The current measured between the magnetic roll and the metering blade is correlated to concentration of the toner particles and the carrier material by means such as a lookup table. As a result of the controller 29 output a dispensing signal to toner particle dispenser 39, to dispenses toner particles into developer housing 40 of developer unit 38 to maintain proper triboelectric properties within the developer unit.

It is, therefore, apparent that there has been provided in accordance with the present invention, a toner maintenance subsystem for a printing machine that fully satisfies the aims and advantages herein before set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A toner maintenance system for an electrophotographic developer unit, comprising:

a sump for storing a quantity of developer material comprised of carrier and toner material;

a member for transporting a mixture of developer material and toner particles from said sump, a power supply for applying voltage to said member;

a metering blade, positioned closely adjacent to said member to maintain the compressed pile height of the developer material on member at a desired level, and maintained at a voltage different from said member by said power supply; and a sensor device for measuring the current between said first member and said metering blade, and generating a signal indicative thereof.

2. A toner maintenance system according to claim 1, further comprising:

a toner reservoir; and a toner dispenser, to transport new toner to said toner reservoir into said sump.

3. A toner maintenance system according to claim 2 further comprising a toner concentration controller, said toner concentration controller adapted to receive a signal from said sensor and to generate an "Add Toner" signal to replenish toner in said sump from said toner reservoir.

4. A toner maintenance system according to claim 1 wherein said first member comprises a magnetic roll.

5. A toner maintenance system according to claim 3 wherein said toner concentration controller includes means for correlating current measurement to a toner concentration measurement.

6. An electrophotographic printing machine having a toner maintenance device in which a toner image is developed on a photoreceptive member, having a toner maintenance device, comprising:

a sump for storing a quantity of developer material comprised of carrier and toner material;

a member for transporting a mixture of developer material and toner particles from said sump, a power supply for applying voltage to said member;

a metering blade, positioned closely adjacent to said member to maintain the compressed pile height of the developer material on member at a desired level, and maintained at a voltage different from said member by said power supply; and a sensor device for measuring the current between said first member and said metering blade, and generating a signal indicative thereof.

7. A printing machine according to claim 6, further comprising:

a toner reservoir; and a toner dispenser, to transport new toner to said toner reservoir into said sump.

8. A printing machine according to claim 7 further comprising a toner concentration controller, said toner concentration controller adapted to receive a signal from said sensor and to generate an "Add Toner" signal to replenish toner in said sump from said toner reservoir.

9. A printing machine according to claim 6 wherein said first member comprises a magnetic roll.

10. A printing machine according to claim 8, wherein said toner concentration controller includes means for correlating current measurement to a toner concentration measurement.

11. A method of maintaining the toner level in a developer housing comprising:

applying a first voltage to a developer carrying member and applying a second voltage a metering blade with a power supply;

measuring the current between the developer carrying member and the metering blade and generating a signal indicative thereof; and calculating the toner concentration as a function of the generated signal.

12. A method according to claim 11, further comprising adding toner to the developer housing as a function of the calculated toner concentration therein.

* * * * *